US006412191B1

(12) United States Patent
Moyls

(10) Patent No.: US 6,412,191 B1
(45) Date of Patent: Jul. 2, 2002

(54) METHOD AND APPARATUS FOR THE REMOVAL OF LIQUID FROM MATERIALS

(75) Inventor: Adrian Leigh Moyls, Summerland (CA)

(73) Assignee: Her Majesty the Queen in Right of Canada, as represented by the Minister of Agriculture and Agri Food Canada, Summerland (CA)

( * ) Notice: Subject to any disclaimer, the term of this patent is extended or adjusted under 35 U.S.C. 154(b) by 0 days.

(21) Appl. No.: 09/832,946

(22) Filed: Apr. 12, 2001

(51) Int. Cl.[7] ..... F26B 5/08

(52) U.S. Cl. ..... 34/328; 34/312; 34/58; 34/367; 198/493; 198/537; 210/787

(58) Field of Search ..... 34/312, 326, 328, 34/360, 359, 368, 580, 586, 592, 593, 58, 367; 198/493, 537, 539, 560, 561; 210/787

(56) References Cited

U.S. PATENT DOCUMENTS 2,666,711 A * 1/1954 Crosset ..... 426/506
4,038,152 A * 7/1977 Atkins ..... 201/2.5
4,251,895 A * 2/1981 Caridis ..... 15/3.13
4,289,471 A * 9/1981 Dunbar ..... 428/373
5,097,755 A * 3/1992 Hill ..... 99/484
5,501,241 A * 3/1996 Jacobson ..... 134/95.2

* cited by examiner

*Primary Examiner*—Ira S. Lazarus
*Assistant Examiner*—Kathryn S. O'Malley
(74) *Attorney, Agent, or Firm*—Sim & McBurney

(57) ABSTRACT

A process for de-watering foodstuffs, such as leafy vegetables, includes moving the foodstuffs along a path, creating an upwardly moving air vortex which intersects the path, thereby raising the foodstuffs upwardly from the path while swirling them in a vortical manner. The foodstuffs raised above the path are received in one end of a duct, the other end of which deposits them on a conveying means. Preferably, the foodstuffs are moved by an air-permeable transport means such as an endless belt. The upwardly moving vortex is created by an air blower which forces air through a tubular portion that contains helically oriented vanes having a tighter and tighter helix in the downstream direction.

15 Claims, 5 Drawing Sheets

METHOD AND APPARATUS FOR THE REMOVAL OF LIQUID FROM MATERIALS

FIELD OF INVENTION

This invention relates generally to the de-watering of materials such as foodstuffs, and has to do particularly with a method and apparatus designed to dewater easily bruised foods such as spinach and lettuce.

BACKGROUND TO THE INVENTION

The popularity of pre-cut and prepared fresh salads, which are ready-to-eat and are often packed in sealed clear plastic bags directly after the food has gone through a washing step, has led to a great increase in the quantity of product that is processed this way. The sealed packages may be individual servings or large institutional sizes. The bags extend shelf life of the product by slowing respiration (lower $O_2$ levels) and by preventing moisture loss.

A potential problem can arise in the form of excess surface water adhering to the product after the washing step, the water subsequently appearing in the sealed bags. This entrapped water is unsightly, can make some components of the salad soggy and limp, provides a site for pathogen build-up and reduces shelf life.

Unfortunately, it is not possible to eliminate this problem merely by removing the-washing step. Washing is necessary in order to remove field soil and, if a chlorinated wash is used, to lower the spore and bacterial loads initially present. The problem of excessive water arises mainly with leafy vegetables, such as lettuce and spinach, which have large surface areas to which water drops readily adhere, although this invention is applicable to any materials that require de-watering.

At the present time, the food industry removes excess water by utilizing batch centrifuges, shakers, or tunnel dryers. Typical commercial centrifuge throughputs range from 1,000 to 6,000 kg/hr, this requiring a number of large machines. The centrifuges are usually expensive batch machines which must be loaded, brought up to speed, stopped and unloaded (which makes them labour and time intensive). Even the so-called automatic centrifugal dryers are nonetheless batch operations, improved by the provision of feed and discharge conveyors to expedite handling between spins. The large g-forces encountered can cause crushing and bruising injury to delicate products as well as increasing cell juice loss and smearing. The shakers are usually vibrating screens which can damage the product, and which, by themselves, usually do not remove enough water. A drying tunnel removes moisture by forced hot-air convection, which evaporates water as the product is continuously conveyed through the tunnel. This tends to lead to excessive dehydration of the portions that are most directly in the airflow. It is desirable to remove only the excess surface water, but not the moisture which occurs naturally within the product. Tunnels are large, slow devices limited by the evaporation rate. They are also energy-intensive, since much more energy is required for an evaporative phase change (liquid to gas) than when mechanically accelerating water off the product. Tunnels, shakers and centrifuges presently in use are often cited as bottlenecks by the industry, which has been seeking a viable alternative that is fast, simple, cheap and effective.

U.S. Pat. No. 5,501,241 is exemplary of the prior art and discloses a device adapted for batch operation, the device including a bucket-shaped container, a domed cover for the container, and a network of tubing through which compressed air is discharged in order to dry food products supported within the container. The dome-shaped cover re-directs upwardly flowing air back down toward the food product, causing certain foods (such as lettuce) to tumble in the resulting air stream. The tube apertures could also be used for washing the product, by first spraying water into the interior of the container. This device exhibits the same disadvantages inherent in all batch-operation devices: necessary stop-start operation and labour intensive.

U.S. Pat. No. 2,666,711, utilizes a concatenation of stages involving washing, immersion, repeated washing, vibrating and drying. While the disclosed apparatus is continuous and does not carry out batch operations, nonetheless the installation is needlessly complex and expensive. For example, a list of parts required would include: blowers, pumps, motors, dampers, valves, nozzles, ducts, seals, separator units, baffles, vibrators, springs, jets, water-baths, fasteners and a framework to hold it all together. As well, there is a risk that delicate food products such as spinach would tend to be bruised or crushed by contact with the vibratory portions. Crosset incorporates three leaf-washing sections upstream of the de-watering section. Crosset accomplishes de-watering by vibrating the mesh conveyor belt and by using air suction to draw the vibrated water droplets away. In the present invention, de-watering takes place by spinning the droplets off the leaves onto an internal duct wall, where they coalesce and drain away by gravity.

SUMMARY OF THE INVENTION

In view of the foregoing disadvantages and failures of prior approaches to the continuous handling of delicate foodstuffs, this invention is directed towards the provision of an apparatus for de-watering foodstuffs, such as spinach and lettuce, which is continuous, inexpensive, effective and reliable.

More particularly, this invention provides, in one aspect, an apparatus for removing liquid from the surfaces of materials, comprising:

- an air-permeable transport for moving the materials along a path,
- an airlift location in said path,
- an air-blower for creating an upwardly moving air vortex which passes through the transport at said airlift location, raising the materials off the transport and swirling them in a vortical manner,
- a conveyor for conveying the materials along a track,
- a duct having an upstream end and a downstream end,
- said upstream end being located above said airlift location, whereby the duct receives the swirling materials at said airlift location,
- said downstream end being located above a deposit location on said conveyor, whereby the swirled materials are deposited onto the conveyor at said deposit location.

Furthermore, this invention provides, in a further aspect thereof, an apparatus for de-watering foodstuffs, comprising:

- air-permeable transport means for moving the foodstuffs along a path,
- an airlift location in said path,
- air-blower means for creating an upwardly moving air vortex which passes through the transport means at said airlift location, raising the foodstuffs off the transport means and swirling them in a vortical manner, thereby de-watering them, conveyor means for conveying foodstuffs along a track, a deposit location on said conveyor means, duct means having an upstream end and a downstream end, said upstream end being located above said airlift location, whereby the duct means receives the swirling air and foodstuffs at said airlift location and conducts them to its downstream end, said downstream end being located above said deposit location on said conveyor means, whereby the swirled foodstuffs are deposited onto the conveyor means at said deposit location.

Finally this invention provides, in an additional aspect, a process for dewatering foodstuffs, comprising the steps:

moving the foodstuffs along a path, creating an upwardly moving air vortex which intersects the path, thereby raising the foodstuffs upwardly from the path while swirling them in a vortical manner, receiving the rising, swirling foodstuffs in one end of a duct, said one end being located adjacent the path, the other end of the duct depositing the foodstuffs on a conveyor means.

BRIEF DESCRIPTION OF THE DRAWINGS

Two embodiments of this invention are illustrated in the accompanying drawings, in which like numerals denote like parts throughout the several views, and in which.

GENERAL DESCRIPTION OF THE INVENTION

Figure 1:
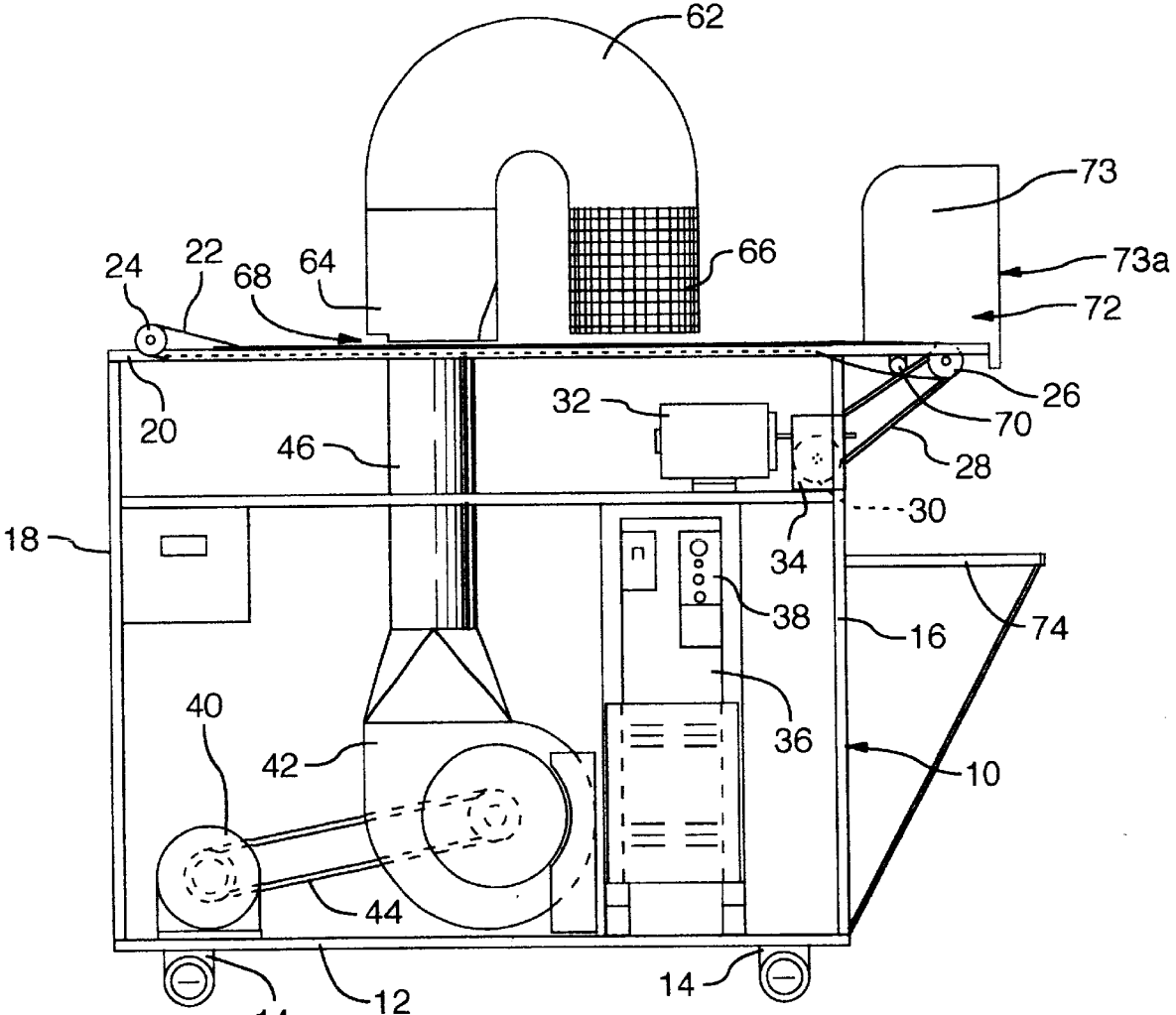
FIG. 1 is a somewhat schematic, side elevational view of one embodiment of an apparatus for carrying out the present invention.

During the operation of the apparatus to be described below, wet food products (such as lettuce and spinach) are conveyed on a mesh belt over a strong air vortex which lifts the product off the belt and spins it. The vortex is created by a vortex generator, described in detail below. The spinning causes 70% to 80% of the surface water to fly off the product and land on the walls of a large inverted U-tube, from which it drains away. The U-tube acts as a duct with an upstream end where the food product enters the duct, and a downstream end where the food product exits the duct.

The de-watered product is then conveyed off the end of the belt to a catching hopper or other receptacle. Alternatively, the product may fall onto another conveyer which transports it to a location where it is portioned, mixed, and bagged with other salad components.

The duct has solid walls over a major portion of its length beginning at the upstream end, the solid walls being intended to receive water and to confine the airflow. Approximately the last quarter of the duct has a mesh screen wall allowing the vortex air to flow laterally out through the screen, while the food product drops gently onto the belt (as opposed to a forced air "body slam" onto the belt).

Finally, the system also employs small air jets blowing up through the belt just before the discharge end. These jets, directed upwardly just in front of the belt drive sprockets, help blow the product off the belt, but act mainly to prevent leaves from getting caught between the belt and the sprockets. The belt speed is adjustable to enable faster product throughput. Also, the airflow of the vortex is adjustable by changing the supply fan speed. This permits the vortex strength to be tailored to any particular product in order to either minimize damage (e.g. in delicate foodstuffs like spinach) or to maximize throughput rate.

The process is fast, and is able to de-water cut lettuce pieces in less than a second. The process is also energy efficient, requiring power only for the conveyor and the fan. No heating is needed to evaporate water, since the water is spun off mechanically. Further, the process is inexpensive, requiring simple, widely available components such as a conveyor, fan, speed controls, and the vortex generator.

The vortex generator, described in greater detail below, is a short section of pipe (45 cm), internally fitted with a pair of intertwining progressive spiral helical guide vanes that impart a twist to the air blown through it. As mentioned earlier, the process is continuous.

In tests performed utilizing lettuce, the vortex system of this invention compared well to the centrifuge de-watering method. The vortex was observed to remove 70 to 80% of the excess water, while the centrifuge removed from 80 to 90%. Product damage was similar for both processes (minimal), as was storage life. The vortex process was very fast, with the throughput of the prototype being limited only by the loading rate onto the upstream end of the belt. Researchers were unable, in these tests, to overload the vortex with product so that the airflow became choked and reduced. The prototype accepted a maximum throughput of 1,000 kg/hr, but the limit was not reached for this small machine. The prototype was also more energy efficient than the centrifuge, using less than one-third of the energy per kg of product, and processing it in less than one-sixth of the time.

DESCRIPTION OF PREFERRED EMBODIMENTS

Referring to the drawings, in FIG. 1, a frame 10 includes a bottom horizontal member 12 from which downwardly extend two spaced-apart flanges 14 supporting axles upon which wheels (not illustrated) can be mounted. End walls 16 and 18 are secured to the ends of the horizontal member 12, and extend upwardly therefrom. At the top of the end members 16,18 is secured an upper member 20 which supports an air-permeable transport means 22 in the form of an endless belt which is trained over upstream sprockets 24 and downstream sprockets 26. The sprockets 24 are idler sprockets, whereas the sprockets 26 are driven by a belt 28 secured around a pulley 30 which receives power from an electric motor 32 through a gear-reduction box 34.

Located on a control panel 36 is a belt speed control 38 which varies the speed of the motor 32 in order to allow a belt speed range of from 0 to 0.4 meters/second.

A fan motor 40 is mounted on the horizontal member 12, as is a centrifugal blower 42, which is driven by the motor 40 utilizing a belt 44. The centrifugal blower forces air into the bottom of an air vortex tube 46. The "downstream end" of the air vortex tube 46 is at its upper end in FIG. 1, located immediately below the endless conveyor 22.

Figure 2:
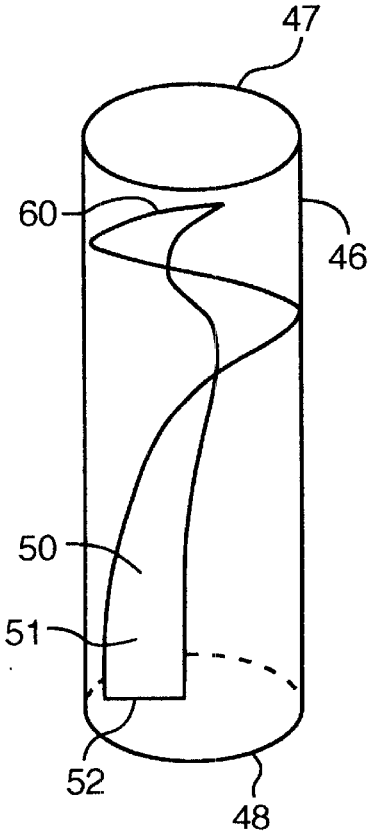
FIG. 2 is a perspective view of portions of an air-swirling component of the apparatus of FIG. 1, the component being drawn as if transparent, revealing a helical vane structure within.
Figure 4:
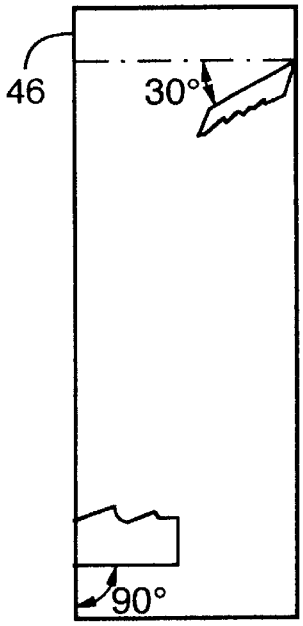

In order for the blown air to lift the food product off the belt 22 and simultaneously begin to swirl the product helically (thus mechanically dewatering the product), the air vortex tube is provided with two internal vanes, a single such vane being best seen in FIG. 2.

In FIG. 2, the air vortex tube 46 is illustrated in perspective, and has two opposite open ends: a downstream end 47 at the top, and an upstream end 48 at the bottom.

Figure 3:
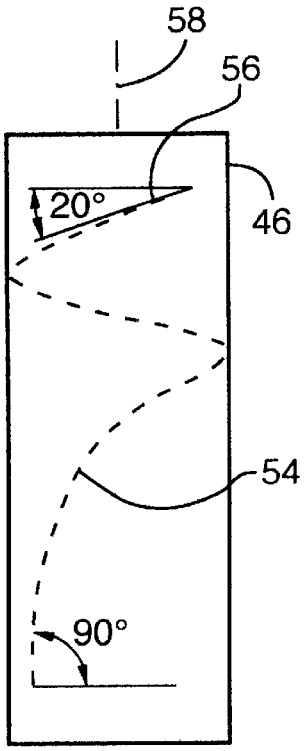
FIGS. 3 and 4 are schematic elevational drawings which illustrate the angulation of the internal helical vane within the tube of FIG. 2.

Within the tube 46 in FIG. 2 there is shown a single, progressive helical vane 50 having a lower end 52 from which a lower portion 51 of the vane extends upwardly while progressively curving into a tighter and tighter helical configuration. This can be better visualized by looking at FIG. 3, in which the broken line 54 represents the junction line along which the vane 50 is attached (e.g. by welding) to the inner wall of the tube 46. The solid, angulated line 56 shows the slope of the helix at its upper end to be approximately 20°, as measured to a hypothetical plane extending perpendicular to the axis 58 of the tube 46.

Between the substantially axially extending lower portion 51 of the vane 50 and the upper end 60 thereof, the vane 50 undergoes a transition into a relatively tight helical configuration.

As the centrifugal blower 42 drives air upwardly through the air vortex tube 46, the air is forced into a vortex about the axis of the tube 46, due to the configuration of the helical vane.

Figure 5:
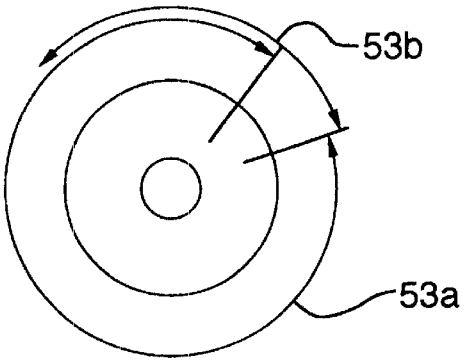
FIG. 5 is a bottom view of the tube shown in FIG. 2.

Attention is now directed to FIG. 5, which shows a bottom view of the tube seen in FIG. 2. The arrow 53*a* shows the circumferential extent of the hallow section of the vane (see upper end) and the arrow 53*b* shows the circumferential extent of the steep section of the vane.

Returning to FIG. 1, there is shown a duct 62, having an inverted U-shape, and further having an upstream end 64 and a downstream end 66.

The duct 62 has both of its ends suspended a short distance above the upper reach of the conveyor 22. The upstream end 64 has a portion removed at 68 which provides a large enough opening to ensure that food travelling along the conveyor 22 will not catch on the upstream end 64 of the duct 62.

For about three-quarters of its length, the duct 62 is imperforate, but the rightward, downstream end portion has an open mesh construction, which allows air that is forced into the upstream end 64 of the duct 62 to pass out of the duct and dissipate its energy.

The upstream end 64 and the downstream end 66 of the duct 62 are both suspended over locations on the conveyor 22, although it is conceivable that (for example) the downstream end 66 could lie adjacent a different conveyor, adapted to carry the food materials off to another step in the process.

The numeral 70 designates an air sweeper plenum, which lies just below the conveyer 22 and just to the left of the drive sprockets 26. The plenum 70 has holes arranged in front of the various drive sprockets for the conveyor belt, and prevents product from catching between the belt and the sprocket teeth. Also provided is an air removal shroud 72, having side walls 73 (only one visible in FIG. 1) and a rightward wall 73*a*, which prevents the product from being blown too far off the end of the belt by the air jets of the plenum 70.

Extending from the frame 10 is a shelf 74, which can support a collection basket (not shown) immediately below the rightward end of the belt 22, in order to collect product.

In operation, the conveyor 22 is driven by drive sprockets 26 and is entrained over idler sprockets 24. Food product (for example, spinach or lettuce) is delivered to the conveyor 22 upstream of the end 64 of the duct 62. The conveyor 22 carries the food product under the upstream end 64 of the duct 62, which can be referred to as an "airlift location" in the path along which the conveyor belt 22 moves. Air blown under pressure into the bottom end of the air vortex tube 46 by the blower 42 acquires a helical or swirling movement superimposed upon the upward movement. The swirling and upwardly moving air raises the food product off the conveyor 22 and swirls it in a vortical manner, as it rises into the duct 62. As the food product moves through the duct 62, the continuing swirling action centrifuges off a large portion of any water which had remained on the food product prior to deposit on the conveyor 22. Most of the removed water clings to the inside surface of the duct 62 in its left hand (upstream) half, and is channelled downward past the belt in such a way as not to re-contaminate the food product with water. The air entering the duct 62 at the upstream end 64 eventually leaves the duct 62 through the mesh at the downstream end 66. Directly under the downstream end 66, the food product drops onto what may be called a "deposit location" on the conveyor 22, from which location the continually moving conveyor 22 carries the food to and beyond the driven end of the conveyor 22. Release from the conveyor and from the belt/sprocket combination is enhanced by air jets proceeding from the plenum 70, as described earlier.

Figure 6:
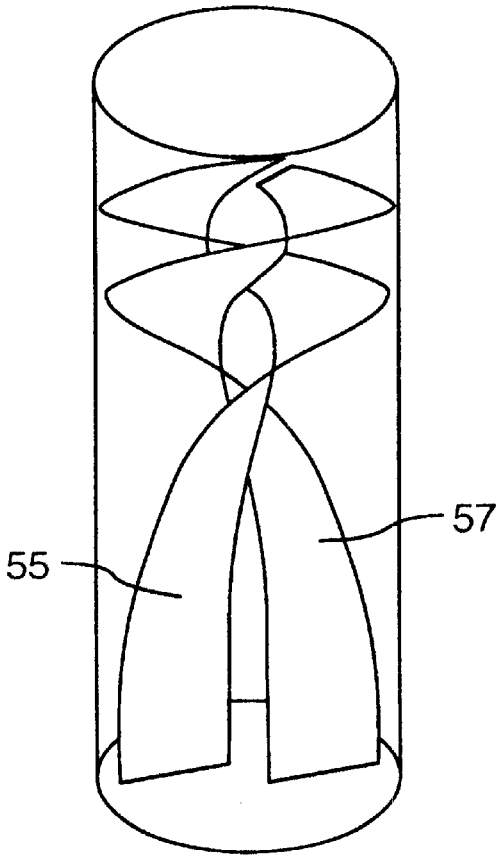
FIG. 6 is a view similar to FIG. 2, in which there are two intertwined vanes mounted inside the tube.
Figure 8:
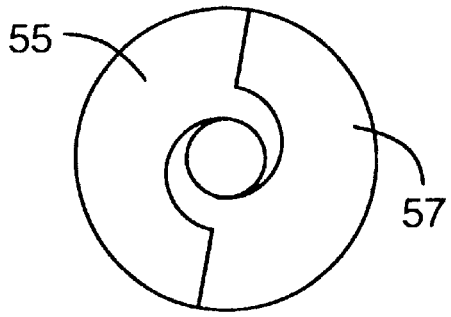
FIGS. 7 and 8 are bottom and top views, respectively, of the tube shown in FIG. 6.
Figure 7:
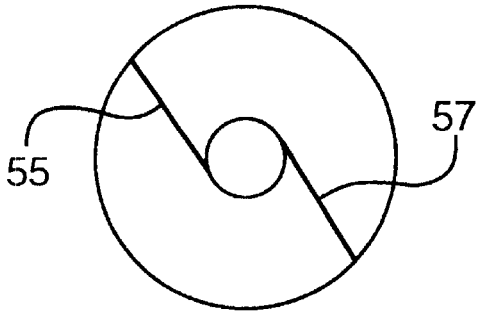
Figure 9:
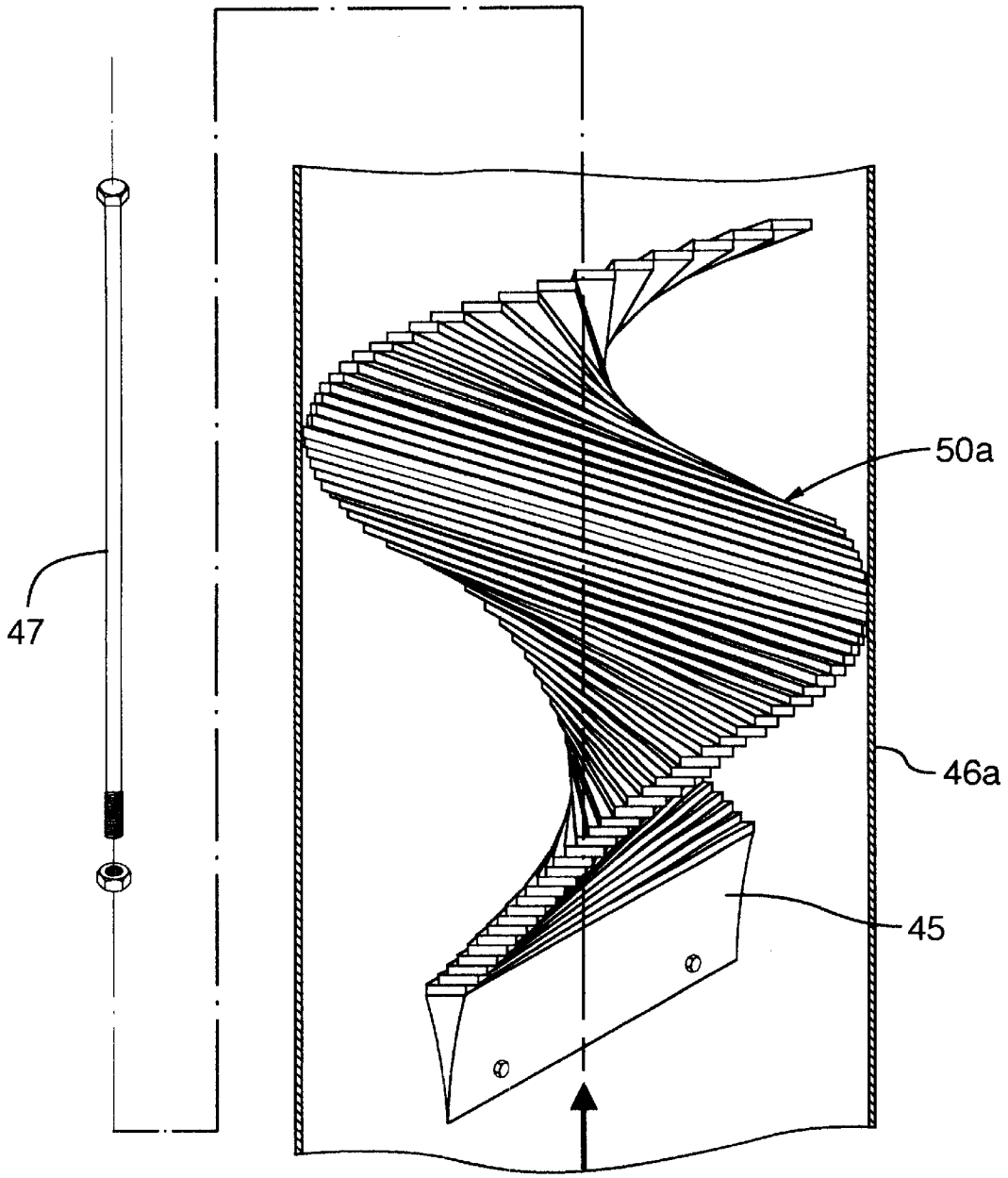
FIG. 9 is a schematic of a second embodiment of a helical vane showing generation of swirl surface by staggering bars, pinched together to form a helix.
Figure 10:
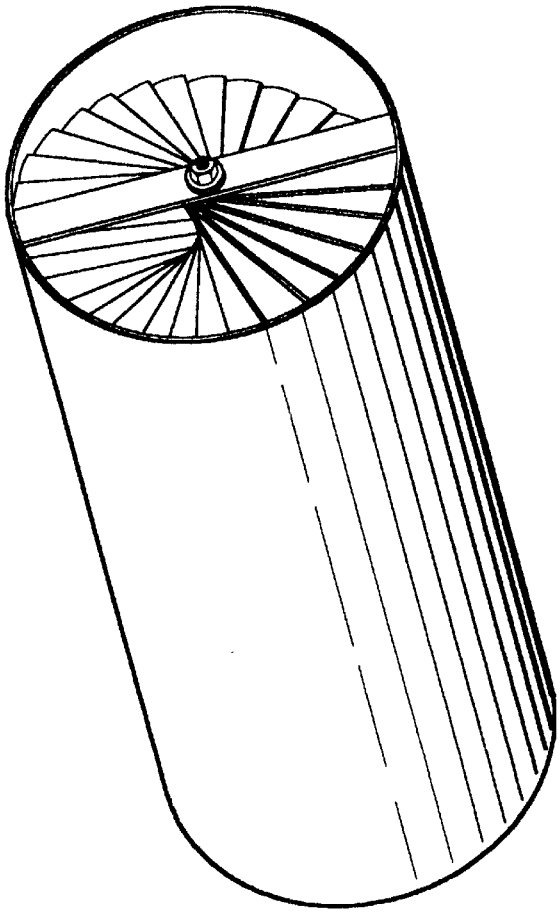
FIG. 10 is a perspective view of a top air exit end of a tube incorporating the helical vane of the second embodiment of the present invention.
Figure 11:
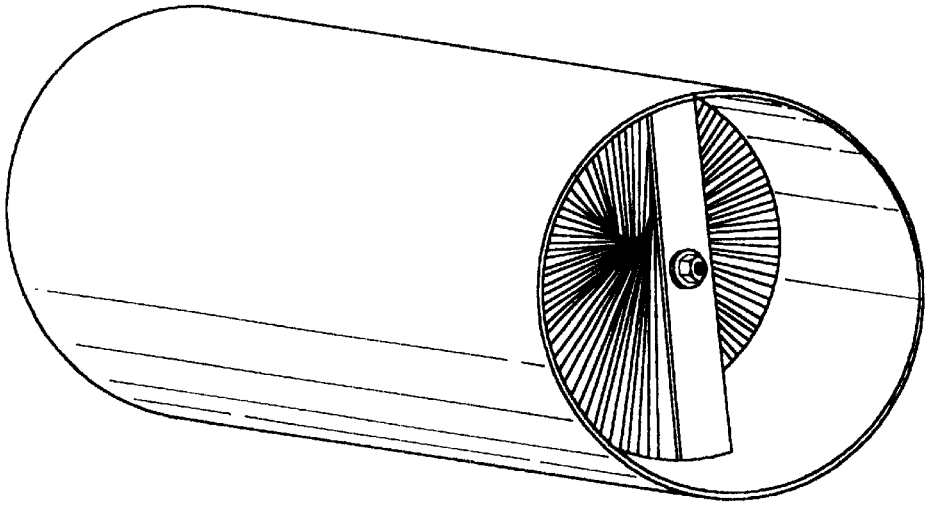
FIG. 11 is a perspective view of a bottom air entry end of a tube incorporating the helical vane of the second embodiment of the invention.

Attention is now directed to FIG. 9 for a description of a second embodiment of the invention, which generates the vortex in a similar manner as the first embodiment of FIG. 6. In the second embodiment, the two helical vanes are made out of a stack of aluminium bars 45 pinched together by a long center bolt 57, and pressed into the vortex tube 46*a* as a unit. The aluminium bars 45 shown in FIG. 9 have dimensions of 1 inch×¼ inch×8 inch, however it will be appreciated that the dimensions may be modified to suit different applications. Curvature is accomplished by rotating each bar 45 relative to its neighbour. A small relative rotation generates a slightly curving, or even straight, section as shown at the upstream end in FIG. 11. Large relative rotations create a strongly curving section as seen at the downstream end in FIG. 10. When the desired positions of all the bars 45 is obtained, the center bolt 57 is tightened to pinch them in place. This design permits adjustments of the vortex generator. The helix can vary from being straight, in which all of the bars 45 are aligned in a straight row, to maximum twist, in which each bar 45 is rotated maximally relative to its neighbour without creating any open space between bars 45. The vanes 50*a* of the second embodiment are one inch wide unlike the sheet metal vanes of the first embodiment.

The most upstream bar 45, which is located at the bottom of the vortex generator, has a 3 inch wedge of stainless steel sheet metal bolted to it to create a more streamlined knife-edge entry for the airflow. Also the entire vortex tube can be rotated in its plenum seat to permit the vortex air emerging from the top vane 50*a* to be directed parallel to the conveyor belt direction, at 90 degrees to the belt direction, or anywhere in between. In this embodiment, the central axis region is blocked off by the one inch wide bars 45, which causes more of the flow energy to be directed into swirl rather than into straight axial flow.

A third embodiment of the invention (not shown) generates the vortex by using an axial flow propeller fan that blows upward from just below the conveyor belt. Flow from a propeller is already swirling, hence there is no need for the vortex tube section, nor the centrifugal blower. This embodiment is simple and may be suitable for light duty operations, however propeller fans are inherently less efficient and less powerful than centrifugal blowers because they cannot pump against as high a static pressure drop. Hence, for the same expenditure of driving power, the propeller fan embodiment is more likely to encounter choked conditions, such as jam-up of layers of product not being lifted off the belt, at high rates of product throughput (kg/hr).

EXAMPLE

A test apparatus was constructed according to the embodiment of FIG. 1 and used to run the process. The fan motor 40 was 3 HP, 3 phase, 220 volt (2.24 kw). The fan itself was a centrifugal blower, wheel width 30.5 cm, wheel diameter 30.5 cm. The maximum speed used was approximately 1770 rpm, delivering approximately 400 cfm at a back pressure of 5 inches water column. The air velocity in the 20 cm (8 inch) tube 46, upstream of the vortex was 6 m/sec (20 ft/sec).

The conveyor belt was 20 cm wide, and had a working length of 1.93 m. The belt 22 was 0.05" diameter, stainless steel wire with a pitch of 0.5 cm (3/16"). The belt construction formed three spaces across the belt width, which made 6 cm×0.5 cm open segments. The open segments were small enough to prevent most product loss through the belt.

As to the rest of the apparatus, the U-tube inlet section (upstream end 64) was 31 cm high by 30.5 cm diameter, made of polycarbonate and thus transparent. This permitted the process to be viewed as the lettuce pieces were lifted off the belt and spun by the air vortex rising up through the belt into the U-tube. In this section, most of the water was spun off and drained down the inside wall where it was routed away from the belt. The upper entry lip of the tube (see recess 68 in FIG. 1) was 3 cm above the surface of the belt 22.

In a fourth embodiment of the invention, the transparent inlet end 64 of the U-tube has an array of narrow slots or holes (not shown) to permit expulsion of water through the walls. The water drains down the exterior of inlet end 64, which facilitates water collection and disposal and prevents the water from rewetting the product. The slots must be small enough to not bleed off significant airflow, which would decrease the strength of the vortex. Also they must not damage the product or cause it to hang up and stick on the tube walls.

In a fifth embodiment of the invention, the transparent inlet end 64 of the U-tube is comprised of a fine mesh stainless steel screen cylinder. The fine mesh cylinder permits the expulsion of water without significantly changing the airflow.

It is considered that the top part of the 30.5 cm diameter U-tube should be made of stainless steel, although the prototype used galvanized steel. It is important to eliminate sharp edges in the duct 62 (U-tube) which could damage the product.

The downstream end or exhaust section 66 of the duct 62 was made of 18 gauge stainless steel screen, with openings 2.0 cm×2.0 cm. It was found that air flow dissipates laterally through the screen, allowing the product to fall gently back onto the belt.

The belt drive motor was ½ HP, 0.37 KW, 115 volt single phase. The belt speed control 38 allowed variation of the motor speed throughout a range of 0 to 0.4 meters/second.

The air sweeper plenum 70 utilized was a 30 cm×5 cm diameter steel pipe with 2.5 mm holes drilled in front of each of six drive sprockets on the conveyor belt. When pressurized to 15 psi, the small air jets from this plenum help lift the lettuce off the end of the belt and prevent leaves from catching between the belt and the sprocket teeth.

The air removal shroud 72 may be a simple sheet of metal (stainless). It functions to prevent product from being blown too far off the end of the belt by the air sweeper. It is open at the bottom to allow product to fall down into a collecting basket (not shown).

The air vortex tube 46 was 55 cm long (22 inches), and 20 cm in diameter (8 inch). For the prototype, the tube 46 contained two air-turning surfaces for generating the vortex (FIG. 6 or FIG. 9). Fan-driven air entered the tube 46 at the bottom as a purely axial flow, and exited the tube with a strong swirl superimposed on the axial flow. The prototype tube was constructed of galvanized steel and aluminum, but a food grade unit would have to be made of stainless steel. Each guide surface had a slow turning 30 cm (12 inch) entrance section which starts out parallel to the air flow direction (i.e. axially of the tube 46). The final 15 cm (6 inch) section curves much more strongly, generating a strong air vortex with minimal friction losses, that exits at 70° to the tube axis. The entry section rotates the airflow 120° around the tube circumference while the final section rotates it a further 320° for a total rotation of 440° through the tube.

SUMMARY OF DISCLOSURE

In summary of this disclosure, the present invention provides method and apparatus for the removal of liquid from materials, such as leafy vegetable products. While several embodiments of this invention had been illustrated in the accompanying drawings and described hereinabove, it will be evident to those skilled in the art that changes and modifications may be made therein, without departing from the essence of this invention, as set forth in the appended claims.

What is claimed is:

1. Apparatus for removing liquid from the outside surfaces of materials, comprising:

an air-permeable transport for moving the materials along a path, an airlift location in said path, an air-blower for creating an upwardly moving air vortex which passes through the transport at said airlift location, raising the materials off the transport and swirling them in a vortical manner, a conveyor for conveying the materials along a track, a duct having an upstream end and a downstream end, said upstream end being located above said airlift location, whereby the duct receives the swirling materials at said airlift location, said downstream end being located above a deposit location on said conveyor, whereby the swirled materials are deposited onto the conveyor at said deposit location.

2. Apparatus for de-watering foodstuffs, comprising:

air-permeable transport means for moving foodstuffs along a path, an airlift location in said path, air-blower means for creating an upwardly moving air vortex which passes through the transport means at said airlift location, raising the foodstuffs off the transport means and swirling them in a vortical manner, thereby de-watering them, conveyor means for conveying the foodstuffs along a track, a deposit location on said conveyor means, duct means having an upstream end and a downstream end, said upstream end being located above said airlift location, whereby the duct means receives the swirling air and foodstuffs at said airlift location and conducts them to its downstream end, said downstream end being located above said deposit location on said conveyor means, whereby the swirled foodstuffs are deposited onto the conveyor means at said deposit location.

3. The apparatus claimed in claim 2, in which the transport means and the conveyor means are different portions of the same endless conveyor, such that said track and said path are in alignment.

4. The apparatus claimed in claim 2, in which the air-blower means forces air through a tubular portion located below said transport means containing helically configured blade means that apply a helical spin to air which is forced therethrough.

5. The apparatus claimed in claim 4, in which said blade means comprises two opposed blade members that undergo a smooth, progressively increasing angulation to the centre axis of the tubular portion in the direction of air movement.

6. The apparatus claimed in claim 5 wherein each of said opposed blade members comprises a stack of aluminum bars pinched together by a long center bolt.

7. The apparatus claimed in claim 2, in which a terminal portion of the duct means, adjacent the downstream end thereof, has a perforate structure allowing the escape of air entering the upstream end.

8. The apparatus claimed in claim 2, in which the duct means has the configuration of an inverted U-shape.

9. The apparatus claimed in claim 2, in which the conveyor means delivers the foodstuffs to a collection hopper.

10. The apparatus claimed in claim 2 wherein said upstream end of said duct means comprises an array of apertures.

11. The apparatus claimed in claim 2 wherein said upstream end of said duct means comprises a fine mesh screen cylinder.

12. The apparatus claimed in claim 11 wherein said fine mesh screen cylinder is comprised of stainless steel.

13. A process for de-watering foodstuffs, comprising the steps:

moving the foodstuffs along a path, creating an upwardly moving air vortex which intersects the path, thereby raising the foodstuffs upwardly from the path while swirling them in a vortical manner, receiving the rising, swirling foodstuffs in one end of a duct, said one end being located adjacent the path, the other end of the duct depositing the foodstuffs on a conveyor means.

14. The process claimed in claim 13, in which the step of moving the foodstuffs is accomplished by an air-permeable transport means.

15. The process claimed in claim 13, in which the upwardly moving vortex is created by an air blower which forces air through a tubular portion that contains helically oriented blade means which give the air a spin as it passes through them.

* * * * *